United States Patent [19]

Heigold et al.

[11] 4,172,731

[45] Oct. 30, 1979

[54] PHOTOGRAPHIC ELEMENT CONTAINING A LIGHT ABSORBING MATTING AGENT

[75] Inventors: Frederick R. Heigold, Rochester; Wesley F. Hoskyns, Fairport, both of N.Y.

[73] Assignee: Eastman Kodak Company, Rochester, N.Y.

[21] Appl. No.: 892,595

[22] Filed: Apr. 3, 1978

[51] Int. Cl.[2] ..... G03C 1/84; G03C 1/00

[52] U.S. Cl. ..... 96/84 R; 96/50 PL; 96/67; 96/87 R

[58] Field of Search ..... 96/50 PL, 84 R, 87 R, 96/67

[56] References Cited

U.S. PATENT DOCUMENTS

| | | | |
|---|---|---|---|
| 2,701,245 | 2/1955 | Lynn | 260/89.5 |
| 3,411,907 | 11/1968 | Whitmore et al. | 96/67 |
| 3,503,743 | 3/1970 | Kosar | 96/87 R |
| 3,507,678 | 4/1970 | Shimizu et al. | 96/84 |
| 3,516,832 | 6/1970 | Earhart et al. | 96/87 R |
| 3,697,277 | 10/1972 | King | 96/50 PL |
| 3,754,924 | 8/1973 | DeGeest et al. | 96/114 Z |
| 3,856,527 | 12/1974 | Hamb et al. | 96/87 R |

FOREIGN PATENT DOCUMENTS

| | | |
|---|---|---|
| 1070272 | 5/1964 | United Kingdom . |
| 1235665 | 6/1968 | United Kingdom . |

*Primary Examiner*—Jack P. Brammer

*Attorney, Agent, or Firm*—Joshua G. Levitt

[57] ABSTRACT

Photographic elements containing a light absorbing matting agent overcome the "starry night" effect.

25 Claims, No Drawings

PHOTOGRAPHIC ELEMENT CONTAINING A LIGHT ABSORBING MATTING AGENT

This invention relates to photographic elements, in particular photographic silver halide elements, having layers containing light absorbing matting agents.

It is known in the photographic art that discrete solid particles of water insoluble organic or inorganic materials, called matting agents, can be used in photographic elements to provide rough surfaces which are often desirable in the photographic art. Typically matting agents are incorporated in the outermost layer of the photographic element. This generally is a separate, protective, layer called an overcoat layer. However, they can be incorporated in an emulsion layer and they need not be in the outermost layer, so long as they impart surface roughness to the element. Examples of organic matting agents are particles, often in the form of beads, of such polymers as polymeric esters of acrylic and methacrylic acid, e.g. poly(methylmethacrylate), cellulose esters, e.g., cellulose acetate propionate, cellulose ethers, ethyl cellulose, polyvinyl resins, e.g., poly(vinyl acetate), styrene polymers and copolymers, polycarbonates, etc. Examples of inorganic matting agents are particles of glass, silicon dioxide, titanium dioxide, magnesium oxide, aluminum oxide, barium sulfate, calcium carbonate, etc.

Matting agents provide an irregular surface to the element in which they are contained and thereby provide sufficient surface roughness to permit retouching or writing on the surface of the photographic material, to prevent the photographic material from sticking to an adjacent surface, and to provide the desired coefficient of friction when the photographic material is intended for use in apparatus for rapid handling and transport. Matting agents also prevent the formation of Newton's rings when printing and enlarging, since the area of contact of the surface of the photographic material with another surface is relatively small due to the spacing effect of the matting agent. Typical matting agents and the way they are used are described in U.S. Pat. Nos. 3,411,907 and 3,754,924.

It has become a common practice in the photographic art to coat more than one layer of a photographic element in a single pass through a coating machine. Typical procedures are described in U.S. Pat. Nos. 2,761,791 and 3,508,947. Drying of such multiple coated layers proceeds from the surface inward. Similarly, as such layers dry the strength of the vehicle increases from the surface inward. As a result of this progressive increase in strength inward during drying, individual particles of the matting agent present in the matte layer are sqeezed into the element and invade the adjacent underlying emulsion layer. The relative diameter of the matting agent particles and the relative thickness of the layer in which they are contained, permit the matting agent to continue to provide surface roughness to the element. However, the effect on the adjacent emulsion layer is to displace silver halide grains laterally, thereby making the silver halide emulsion layer thinner at those sites which have been invaded by matting agent.

When such an element is imagewise exposed and processed, the image density in the area underlying a particle of matting agent which has invaded the emulsion layer is diminished compared with other areas in the emulsion that have received equivalent exposure. These areas of decreased image density appear as small white spots in the image. The resulting visual effect has been called the "starry night" effect, due to the visual similarity of the image area to the sky on a clear, starry night.

It would be desirable to provide photographic elements containing matting agents which do not exhibit the starry night effect even though they are coated in multiple layer coating operations.

We have found that this can be accomplished with matting agents which absorb light of the same color as the light absorbed by the image to be formed in the adjacent emulsion layer.

Accordingly, in one embodiment this invention relates to a photographic element comprising a support bearing at least one layer of a radiation sensitive silver halide emulsion and, overlying and adjacent said emulsion layer, a layer of a transparent polymeric vehicle containing a matting agent, wherein the matting agent absorbs light of the same color as absorbed by the image to be formed in the adjacent emulsion layer.

In another embodiment, this invention relates to a process of preparing a photographic element comprising a support bearing at least one layer of a radiation sensitive silver halide emulsion and, overlying and adjacent said emulsion layer, a layer of a transparent polymeric vehicle containing a matting agent, by coating the overlying layer on the adjacent silver halide emulsion layer, wherein the matting agent is colored to absorb light of the same color as absorbed by the image to be formed in the adjacent emulsion layer.

The matte layer of the elements of this invention provide the same advantageous effects as prior art matte layers. Moreover, they improve on prior art matte layers since they reduce or eliminate the starry night effect by compensating for image density which is lost by displacement of silver halide grains in the adjacent silver halide emulsion layer. Preferably, the matte layer is the outermost layer of the photographic element and is coated simultaneously with the adjacent emulsion layer.

Photographic elements of the present invention can be photographic elements designed to provide multicolor images or elements designed to provide single color images, including black-and-white images. With photographic elements which yield multicolor images the matting agent would have the same color as the image record formed in the adjacent silver halide layer. With photographic elements which yield single color images, the matting agent would have the color (including black) of the image formed in the element. In a preferred embodiment of this invention the photographic element is a black-and-white silver halide graphic arts product and the matting agent is black.

The matting agent can be any of the matting agents which have heretofore been employed in photographic elements, examples of which are listed above, but which have been colored to absorb light of the desired color. For example, this can be accomplished by coating the matting agent with a layer of a dye or a pigment. A preferred class of matting agents are polymeric matting agents. With polymeric matting agents it is particularly convenient to incorporate a dye or pigment of the desired color in the matting agent during its formation, rather than subsequently coating the matting agent with the dye or pigment. Particularly preferred polymeric matting agents are spherical beads of polymeric esters of acrylic and methacrylic acid, especially poly(methyl methacrylate), and spherical beads of polyvinyl resins, especially polystyrene. While the size of the matting agents will depend upon such factors as the thickness of the layer in which they are incorporated, a useful average diameter is between 2.5 and 15 microns. Beads with a mean average diameter of between 2.5 and 10 microns are particularly useful and beads with a mean average diameter of 4 to 6 microns are particularly preferred.

Polymeric matting agents used in this invention should contain a dye or a pigment in a sufficient amount to impart to the matting agent the requisite optical density to mask areas of minimum density resulting from displacement of silver halide grains. The dye or pigment can be any dye or pigment which is compatible with and can be incorporated in the polymer which forms the matting agent. When used in a multicolor element, which typically has a yellow image layer as the emulsion layer adjacent the overcoat, the matting agent would contain a yellow dye or pigment. When used in an element that yields a single color image, such as a separation halftone, the matting agent would contain a cyan, magenta or yellow dye or pigment. When used in an element in which a silver image is formed, the matting agent would contain a black dye or pigment. A preferred black pigment is carbon black. When carbon black is employed as the pigment, requisite optical density can be obtained by employing from 2 to 15 percent carbon black by weight based on the weight of the polymer. Particularly preferred are polymeric beads which contain from 4 to 8 percent carbon black by weight based on the weight of the polymer.

Matting agents useful in this invention can be prepared by techniques known in the art. One technique is to incorporate a dye or pigment in a polymer during polymerization. Another technique is to incorporate the dye or pigment in the polymer after polymerization, e.g. by milling, followed by grinding and classifying. Solution polymerization of a monomer in the presence of a dye or pigment by techniques which yield spherical beads is a preferred way of preparing the matting agents used in this invention. Polymeric particles, including polymeric beads, in which pigments such as carbon black are dispersed are used in the art of electrophotography as toners, and other suitable techniques can be selected from that art to prepare matting agents useful in this invention. Conversely, the specific matting agents prepared in Example 1, hereinafter, can be used in the art of electrophotography as toners, for example, as pressure sensitive or heat fusible toners.

The transparent polymeric vehicle in which the matting agents is dispersed can be any of the vehicles conventionally employed in photographic elements. These would include synthetic and naturally occurring hydrophilic colloids. Gelatin (including alkali processed gelatin, acid processed gelatin and mixtures thereof) and gelatin derivatives are preferred vehicles. They can be used alone or in combination with one another or with other colloids.

It will be appreciated that by incorporating a light absorbing material in an overcoat layer which is interposed between the source of exposure and the light sensitive layer, light transmission through the overcoat layer will be reduced. This can be compensated for by modifying the sensitivity (speed) characteristics of the silver halide emulsion, by modifying the exposure conditions, or by combinations of the two. However, the matting agent should not be incorporated in the layer in an amount which would prevent viewing of the image formed in the light sensitive layer or layers. Thus a balance must be struck between incorporating sufficient matting agent in the overcoat layer to provide an effective matte surface and not incorporating so much matting agent as to interfere unduly with the light transmissive properties of the overcoat layer. The ratio of matting agent to vehicle to achieve this balance will vary depending upon the particular vehicle employed, the particular matting agent, the way in which the matting agent is colored, and the like. A weight ratio of vehicle to matting agent of from 4:1 to 50:1 is generally suitable. Particularly preferred is a ratio of vehicle to matting agent of from 6:1 to 10:1.

Typically the overcoat layer will have a dried thickness of 0.05 to 0.15 micron.

In addition to the colored matting agent, the overlying layer can contain addenda conventional in the photographic art such as hardening agents, coating aids, surfactants, additional matting agents, and the like.

The radiation-sensitive silver halide emulsions can include coarse, regular or fine grain silver halide crystals or mixtures thereof and can be comprised of such silver halides as silver chloride, silver bromide, silver bromoiodide, silver chlorobromide, silver chloroiodide, silver chlorobromoiodide and mixtures thereof. Such silver halide emulsions typically are gelatin emulsions although other hydrophilic colloids can be used in accordance with usual practices.

The silver halide emulsion can contain the usual additives, including, for example, stabilizers, antifoggants, spectral sensitizing dyes, speed increasing addenda, surfactants and the like.

The photographic elements of this invention can be those which provide images of a single color, including black-and-white images, or they can be those which provide multicolor images. The silver halide emulsion can be a single layer or can be subdivided to two or more sublayers having the same or different sensitometric and/or physical properties, such as photographic speed, spectral sensitivity, thickness, distribution of components and the like. The silver halide emulsion can have associated with it a color forming coupler, or such a coupler can be introduced into the layer during processing. With elements intended to form a multicolor image, the element will typically have a plurality of silver halide emulsion layers sensitive to different regions of the visible spectrum. For example, one or more silver halide layers sensitive to red light, one or more silver halide layers sensitive to green light and one or more silver halide layers sensitive to blue light.

The elements of this invention can contain additional layers conventional in photographic elements such as spacer layers, filter layers, antihalation layers, scavenger layers, and the like.

The support used with the photographic elements of this invention can be any of the conventional transparent or opaque support normally used in the photographic art, such as film, glass and paper. This invention is of particular utility with transparent film supports such as films of cellulose nitrate, cellulose acetate, poly(vinyl acetal), polystyrene, poly(ethylene terephthalate), polyethylene, polypropylene and related films.

The photographic elements of this invention can be prepared by techniques conventionally employed to prepare photographic elements. As indicated above, the colored matting agents employed in the invention yield particularly advantageous results when the element is prepared by a technique in which multiple layers of the element, including the overcoat layer and an adjacent emulsion layer, are coated in a single pass through the coating machine.

The following examples further illustrate the invention. In these examples, Example 1 describes the preparation of polymeric beads useful as matting agents by a procedure which is particularly advantageous in that it breaks down aggregates of pigment into smaller units and thereby produces optimum particle pigmentation. Example 2 describes the preparation and use of a photographic element according to this invention.

In the following examples all percentages are by weight, unless otherwise indicated.

EXAMPLE 1

Preparation of Pigmented Beads

Part I-A—Preparation of Carbon-Monomer Dispersion—A mixture of 15 percent carbon black (Regal 300 Carbon sold by Cabot Corp.), 7.5 percent of an octyl phenoxy polyethoxy ethanol surfactant (Triton X-15 sold by Rohm and Hass Co.), and 77.5 percent methyl methacrylate were ball milled for three days, then diluted to 6 percent carbon with additional methyl methacrylate.

Part I-B—Preparation of Polymer-Coated Carbon—Poly(n-butyl methacrylate), having an inherent viscosity of 0.26 measured in acetone, was hot-roll milled in a weight ratio of 1:1 with carbon black (Regal 300 sold by Cabot Corp.). After cooling, the material was ground to provide particles having an average diameter of several millimeters and then was dissolved in sufficient methyl methacrylate to reduce the carbon concentration to 6 percent.

Part III—Preparation of Pigmented Beads—To each of Part I-A and Part I-B was added 2.66 percent, based on carbon and monomer, of a dioctyl ester of sodium sulfosuccinic acid surfactant (Aerosol OT-100, sold by American Cyanamide Co.). Then 2.66 percent of a lauroyl peroxide polymerization initiator was added and each of the mixtures was stirred 30 minutes at 150 rpm in a 20° C. bath. Water was added to bring each of the mixtures to 16.16 percent (total solids), and each of the mixtures was pumped through a colloid mill set at 0.005" and 880 rpm, at a rate of 2.0 gal/min into a 10-gallon reactor. The reactor was maintained at 50° C., and each of the mixtures stirred at 15 rpm for 18 hours. During the course of the reaction period there precipitated from the reaction mixtures polymeric beads throughout which carbon black was dispersed. Each of the finished polymer suspensions was filtered through cheese cloth to yield black beads having a mean average diameter of 4.5 microns.

EXAMPLE 2

A reduction and gold fogged direct-positive silver bromoiodide emulsion (0.30 μm, 1.5 mole percent iodide), comprising, 1,3-diallyl-2-[2-(3,5-dimethyl-1-phenyl-4-pyrazolyl)vinyl]imidazo[4,5-b]quinoxalinium iodide as an electron-accepting dye adsorbed to the surface of the silver halide, was coated on a poly(ethylene terephthalate) film support at 4.09 g Ag/m$^2$ and 3.01 g gelatin/m$^2$. An interlayer comprising 1.94 g gelatin/m$^2$ was coated over the emulsion layer. Then black beads prepared as described in Example 1 Parts I-A and II were combined with gelatin and coated over the interlayer at 0.48 g gelatin/m$^2$, 0.11 poly(methyl methacrylate/m$^2$ and 0.007 g carbon/m$^2$. This was designated Element A.

A comparison element, designated Element B, was made in the same way as Element A, except that clear poly(methyl metacrylate) beads were employed instead of the black beads.

Both elements were processed (without exposures) to yield a uniform density of 3.5. Each of the elements was visually examined with transmitted light using a 10X magnifier. The starry night effect was not observed in Element A, but was observed in Element B.

This invention has been described in detail with particular reference to preferred embodiments thereof, but it will be understood that variations and modifications can be effected within the spirit and scope of the invention.

What is claimed is:

1. In a photographic element comprising a support bearing at least one layer of a radiation sensitive silver halide emulsion and, overlying and adjacent said emulsion layer, a matte layer of a transparent polymeric vehicle containing a matting agent, the improvement wherein the matting agent comprises pigmented polymeric particles which are of the same color as the image to be formed in the adjacent emulsion layer.

2. A photographic element of claim 1 wherein the weight ratio of transparent polymeric vehicle to matting agent is between 4:1 to 50:1.

3. In a photographic element comprising a support bearing at least one layer of a radiation sensitive silver halide emulsion and, overlying and adjacent said emulsion layer, a matte layer of a transparent polymeric vehicle containing a matting agent, the improvement wherein the matting agent comprises black polymeric particles.

4. A photographic element of claim 3 wherein the layer containing the matting agent is the outermost layer of the photographic element.

5. A photographic element of claim 4 wherein the transparent polymeric vehicle is gelatin, a gelatin derivative or combinations thereof.

6. A photographic element of claim 4 wherein the black polymeric particles are spherical polymeric beads having carbon black dispersed therein.

7. A photographic element of claim 5 wherein the black polymeric particles are spherical beads of a polymeric ester of acrylic or methacrylic acid or a polyvinyl resin, the beads having carbon black dispersed therein.

8. A photographic element of claim 6 wherein the polymeric beads are comprised of poly(methyl methacrylate).

9. A photographic element of claim 6 wherein the polymeric beads have a mean diameter of 2.5 to 10 microns.

10. A photographic element of claim 8 wherein the polymeric beads have a mean diameter of 4 to 6 microns.

11. A photographic element of claim 6 wherein the polymeric beads comprise 2 to 15 percent by weight carbon black.

12. A photographic element of claim 8 wherein the polymeric beads comprise 4 to 8 percent by weight carbon black.

13. A photographic element of claim 6 wherein the weight ratio of vehicle to beads is from 4:1 to 50:1.

14. A photographic element of claim 8 wherein the weight ratio of vehicle to beads is from 6:1 to 10:1.

15. A photographic element of claim 5 wherein the outermost layer has dry thickness of 0.05 to 0.15 micron.

16. In a photographic element comprising a support bearing a layer of a silver halide emulsion and, adjacent said emulsion layer, an overcoat matte layer comprising gelatin and a matting agent, the improvement wherein the matting agent comprises spherical beads of poly(-methyl methacrylate) in which is dispersed from 2 to 15 percent carbon black, the beads having a mean diameter of 2.5 to 10 microns and the weight ratio of bead to gelatin in the overcoat layer being from 1:6 to 1:10.

17. In a process of preparing a photographic element comprising a support bearing at least one layer of a radiation sensitive silver hallide emulsion and, overlying and adjacent said emulsion layer, a matte layer of a transparent polymeric vehicle containing a polymeric matting agent, by coating said overlying layer over said adjacent silver halide emulsion layer, the improvement comprising coloring the matting agent so that it is of the same color as the image to be formed in said adjacent emulsion layer.

18. A process of claim 17 wherein the emulsion layer and the overlying matte layer are coated simultaneously.

19. A process of claim 17 wherein the matting agent is comprised of polymeric particles colored by dispersing a pigment therein.

20. A process of claim 19 wherein carbon black is dispersed in the polymeric particles during polymerization.

21. In a process of preparing a photographic element comprising a support bearing at least one layer of a radiation sensitive silver halide emulsion and, adjacent said emulsion layer, an outermost matte layer of a transparent polymeric vehicle containing a polymeric matting agent, by simultaneously coating said outermost matte layer and said adjacent silver halide emulsion layer, the improvement wherein the matting agent is the same color as the image to be formed in said adjacent emulsion layer.

22. In a photographic element comprising a support bearing at least one layer of a radiation sensitive silver halide emulsion and, overlying and adjacent said emulsion layer, a matte layer of a transparent polymeric vehicle containing a matting agent, the improvement wherein the matting agent comprises cyan polymeric particles.

23. In a photographic element comprising a support bearing at least one layer of a radiation sensitive silver halide emulsion and, overlying and adjacent said emulsion layer, a matte layer of a transparent polymeric vehicle containing a matting agent, the improvement wherein the matting agent comprises magenta polymeric particles.

24. In a photographic element comprising a support bearing at least one layer of a radiation sensitive silver halide emulsion and, overlying and adjacent said emulsion layer, a matte layer of a transparent polymeric vehicle containing a matting agent, the improvement wherein the matting agent comprises yellow polymeric particles.

25. In a photographic element comprising a support bearing at least one layer of a radiation sensitive silver halide emulsion and, overlying and adjacent said emulsion layer, a matte layer of a transparent polymeric vehicle containing a matting agent, the improvement wherein the matting agent comprises black spherical polymeric beads having a mean diameter of 2.5 to 10 microns and wherein the weight ratio of vehicle to beads is between 4:1 to 50:1.

* * * * *